US006953386B1

(12) United States Patent
Korinek et al.

(10) Patent No.: US 6,953,386 B1
(45) Date of Patent: Oct. 11, 2005

(54) ACTIVE SPARK CONTROL

(75) Inventors: Richard Korinek, Lenexa, KS (US); Victor Jaugilas, Kansas City, KS (US); William G. Walls, Basehor, KS (US)

(73) Assignee: RailWorks Corporation, New York, NY (US)

( * ) Notice: Subject to any disclaimer, the term of this patent is extended or adjusted under 35 U.S.C. 154(b) by 0 days.

(21) Appl. No.: 10/894,198

(22) Filed: Jul. 19, 2004

(51) Int. Cl.[7] ..... B24B 1/00
(52) U.S. Cl. ..... 451/28; 451/347; 451/429
(58) Field of Search ..... 451/28, 56, 344, 451/347, 429

(56) References Cited

U.S. PATENT DOCUMENTS

| | | | | |
|---|---|---|---|---|
| 4,178,724 | A | 12/1979 | Bruno | |
| 4,249,346 | A | 2/1981 | Theurer et al. | |
| 4,347,688 | A | 9/1982 | Scheuchzer et al. | |
| 4,492,059 | A | 1/1985 | Panetti | |
| 4,583,327 | A | 4/1986 | Jaeggi | |
| 4,622,781 | A | 11/1986 | Vieau et al. | |
| 4,779,384 | A | 10/1988 | Shoenhair et al. | |
| 4,785,589 | A | 11/1988 | Buhler | |
| 5,111,624 | A | 5/1992 | Shoenhair et al. | |
| 5,359,815 | A | 11/1994 | Schrunk, III et al. | |
| 5,567,196 | A | 10/1996 | Theurer | |
| 5,575,709 | A | 11/1996 | Hertelendi et al. | |
| 5,580,299 | A | 12/1996 | Pomikacsek | |
| 6,033,291 | A | 3/2000 | Mathison et al. | |
| 6,719,616 | B2 * | 4/2004 | Mathison et al. | 451/58 |
| 2003/0143928 | A1 * | 7/2003 | Knoll et al. | 451/28 |

* cited by examiner

*Primary Examiner*—Jacob K. Ackun, Jr.
(74) *Attorney, Agent, or Firm*—Buchanan Ingersoll PC

(57) ABSTRACT

A method and apparatus for directing a spark stream generated by contact between a rotating grinding stone and a railhead away from nearby combustible material, wherein the grinding stone is tilted at an angle such that only one of the leading and trailing edges of the grinding stone contacts the railhead during the grinding operation. The leading or trailing edge is selected such that the spark stream is directed away from the nearby combustible material. The apparatus can include tilting assembly, associated with a grinding unit, including a grinding stone, which is controllable to tilt the grinding unit at an angle to the railhead during the grinding operation such that only one of the leading and trailing edges of the grinding stone contacts the railhead during the grinding operation.

12 Claims, 7 Drawing Sheets

ACTIVE SPARK CONTROL

BACKGROUND

The invention relates generally to machines for grinding and reforming the surfaces of railroad track rails. More particularly, the invention relates to an apparatus and method for directing a spark stream generated by contact between a rotating grinding stone and a railhead away from combustible materials in the vicinity of the grinding operation.

Railroad track rails are subject to wear by the passage of trains over the rails, and the head surfaces of railroad track rails which are in direct contact with the wheels and wheel flanges of rolling stock tend to wear unevenly. In particular, the cross sectional contour of the head can become misshapen, and depressions in the top surface of the railhead may develop such that the railhead presents a modulating, corrugated surface. Moreover, the railhead may develop burrs or otherwise lose its symmetrical profile. Such defects create undesirable vibration, particularly at high speeds, and also produce high noise levels. Maintenance of smooth running surfaces on railroad track rails is therefore important for reasons of safety, riding comfort, protection of the track, track bed and rolling stock, noise suppression.

Grinding machines have been developed for maintaining railroad track rails in smooth, properly shaped condition. Such grinding machines generally comprise a plurality of rotatable grinding modules carried by a locomotive or the like in close proximity to the railhead surfaces of the track rail. The grinding modules include rotatable, abrasive grinding stones that can be lowered into a position flush with the rail surface to grind and restore the rail surface to a smooth, desired profile. In particular, on-track grinding trains carrying arrays of heavy grinding stones powered by high horsepower motors have been used in such grinding operations. An example of such a rail grinding car is disclosed in U.S. Pat. No. 4,583,327, in which there is described a rail grinding car having vertical and horizontal grinding stone units. Horizontal grinding stones are generally annular with a flat, annular face being the grinding surface, whereas vertical grinding stones grind with an outer cylindrical surface of the stone. This grinding car embodies positioning control of an array of vertical grinding stones so that each stone properly engages the rail, and wherein the horizontal grinding stones are individually positionable to provide flexibility in grinding location and concentration on the rail heads.

A well known problem with rail grinding machines is the generation of sparks and swarf, which is an intimate mixture of metal and/or stone grinding chips and fine abrasive dust generated by the grinding operation. Sparks can be particularly troubling because of the potential to start fires. Sparks directed to the outside, i.e., "field" side, of the rails can set fire to brush and dried vegetation along the tracks. Additionally, sparks directed toward the "gauge" side, i.e., inside, of the rails, can set fire to the railroad ties. The sparks can also present a safety hazard to personnel involved in the grinding operation. Often, the mere threat of a fire hazard in extremely dry areas may require the cessation of grinding activities, prolonging the time to accomplish necessary track maintenance and increasing maintenance costs.

A number of designs have been proposed to contain, suppress, or evacuate the sparks and swarf by-products of rail grinding. For example, some grinding machines have been fitted with metal flaps on the field sides of the machines in proximity to the grinding stones. Such flaps are effective in containing some of the byproducts by presenting a physical barrier. The aforesaid U.S. Pat. No. 4,583,327 discloses a rail grinding machine wherein the grinding stones are surrounded by shrouds, and a source of negative pressure cooperates within the shrouds to pull dust and sparks away from the grinding area. U.S. Pat. No. 5,111,624, assigned to Loram Maintenance of Way, Inc., discloses a grinding machine for limiting the dispersion of sparks and swarf wherein a fan is carried by the grinding head assembly, above the grinding stone, of a railroad track rail grinding unit. The fan rotates with the grinding stone during grinding operations and creates a downward draft of air to limit the dispersion of sparks and swarf. Water and/or a surfactant can also be introduced into the downdraft. The '624 patent assigned to Loram Maintenance of Way, Inc., also refers to a grinding machine wherein water is sprayed by specially designed and positioned nozzles in the vicinity of the grinding area.

However, the efforts described above can be less effective than desired for controlling the potential for sparks emanating from the grinding operations to cause fires, either by igniting brush on the field side of the rails, or the railroad ties on the gauge side thereof. All of the devices described above are directed toward containing the sparks (and swarf), or limiting the dispersion thereof. Moreover, these efforts have not been very successful, as sparks from rail grinding operations continue to be a significant problem in rail grinding operations.

Accordingly, there is a need for an apparatus and method for reducing the likelihood that sparks generated by rail grinding operations will cause a fire.

SUMMARY

According to the invention, a method and apparatus can be provided to direct a spark stream generated by contact between a rotating grinding stone and a railhead away from nearby combustible material. The method can generally comprise tilting the grinding stone at an angle such that only one of the leading and trailing edges of the grinding stone contacts the railhead during the grinding operation. The leading or trailing edge can be selected such that the spark stream generated by the grinding operation is directed away from nearby combustible materials.

An embodiment of an apparatus for grinding a railhead in a manner to direct the spark stream away from nearby combustible material can generally comprise grinding unit, including a rotatable grinding stone at one end thereof, a support member adapted to hold the grinding unit in a position with the grinding stone against the railhead during a grinding operation, a tilting assembly associated with the support member and the grinding unit, wherein the tilting assembly is controllable to tilt the grinding unit such that the grinding stone is held at an angle against the railhead with only one of the leading or trailing edges in contact with the railhead during the grinding operation. Whether the leading or trailing edge is selected can be based upon the side of the railhead which is being ground. More specifically, the leading or trailing edge is selected such that a spark stream generated by the grinding operation is directed away from nearby combustible material. The grinding unit is tilted in a plane which is defined by an axis of rotation of the grinding stone and a longitudinal axis of the railhead, such that the tilt angle causes only one of the leading and trailing edges to contact the railhead during the grinding operation.

According to a preferred embodiment of the invention, the tilting assembly can further comprise a tilt bracket connected to the grinding unit via upper and lower pairs of parallel arms, wherein the upper pair of parallel arms are connected between an upper portion of the tilt bracket and an upper part of the grinding unit and the lower pair of parallel arms are connected between a lower portion of the tilt bracket and a lower part of the grinding unit adjacent the grinding stone. To provide the tilt angle, the upper pair of parallel arms can be connected to the tilt bracket via an eccentric assembly wherein rotation of the eccentric assembly shortens or lengthens the upper pair of parallel arms relative to the lower pair of parallel arms such that the grinding unit, and thus the grinding stone, is tilted relative to the railhead. The eccentric assembly can comprise a shaft connected between the upper pair of parallel arms, a hollow tubular member disposed over the shaft for rotation relative the shaft. The hollow tubular member has an inner axis coaxial with the shaft and an outer axis which is eccentric to the inner axis. The upper portion of the tilt bracket can be carried by the hollow tubular member, wherein rotation of the hollow tubular member relative to the shaft will shorten or lengthen the upper pair of parallel arms relative to the lower pair of parallel arms, and thus tilt the grinding unit. An actuator can be also provided connected to the hollow tubular member for rotating the hollow tubular member relative to the shaft to tilt the grinding unit. The actuator can be, for example, a variable length member having a fixed end and a second end movable toward the fixed end. The hollow tubular member can be provided with a lever extending therefrom, or otherwise attached to, to which the movable end of the actuator is attached. In this manner, movement of the second end of the variable length member toward the first end thereof rotates the hollow tubular member relative to the shaft to shorten or lengthen the upper pair of parallel arms relative to the lower pair of parallel arms. In a preferred embodiment of the invention, the actuator can be a hydraulic cylinder, and can be remotely controllable, such as by a computer.

Further details, objects, and advantages of the invention will become apparent from the following detailed description and the accompanying drawings figures of certain embodiments thereof.

BRIEF DESCRIPTION OF THE DRAWING FIGURES

A more complete understanding of the invention can be obtained by considering the following detailed description in conjunction with the accompanying drawings in which.

DETAILED DESCRIPTION

To better understand the invention, it is helpful to first understand conventional rail grinding procedures and equipment. The function of rail grinding operations is to grind the surface of the railhead to remove imperfections and reform the shape of the railhead to reduce rolling friction and vibration. The reduction in friction and vibration result in reduced operating costs, increased passenger comfort, and higher operating speeds.

Figure 1:
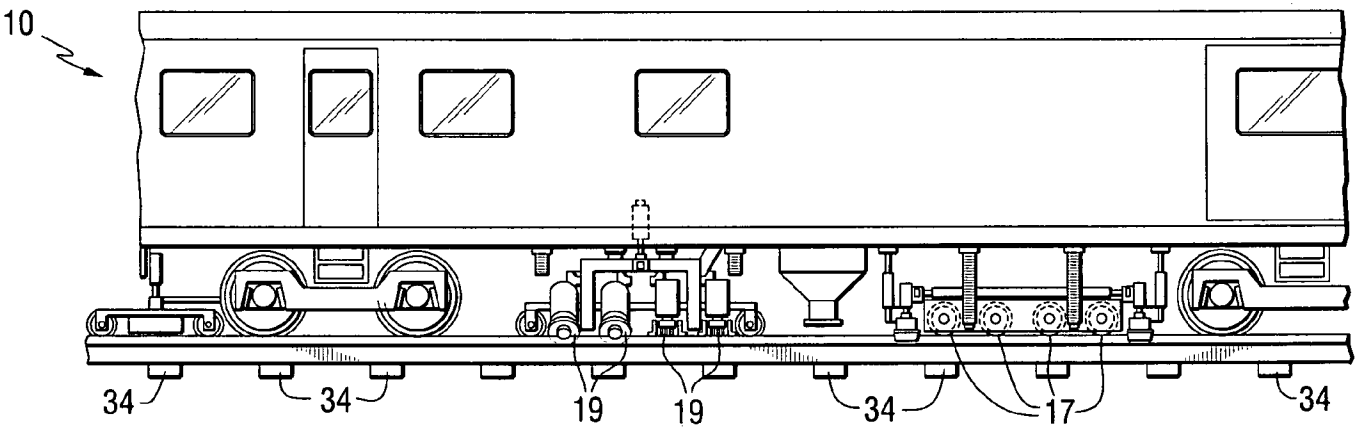
FIG. 1 PRIOR ART
FIG. 1 is a prior art type rail grinding car.

Referring to FIG. 1 (which corresponds to FIG. 1 of U.S. Pat. No. 4,583,327, described previously) a prior art rail grinding car 10 is shown which travels along rails 14 which are to be resurfaced by multiple grinding units 17, 19, suspended from the underside of the grinding car 10. As shown, this rail grinding car 10 carries two types of grinding units, vertical grinders 17 and horizontal grinders 19. Each type of grinding unit 17, 19 includes a motor driven grinding stone which is positioned against the railhead 14 at an angle designed to grind the railhead 14 to have a desired surface configuration and/or smoothness.

Figure 2B:
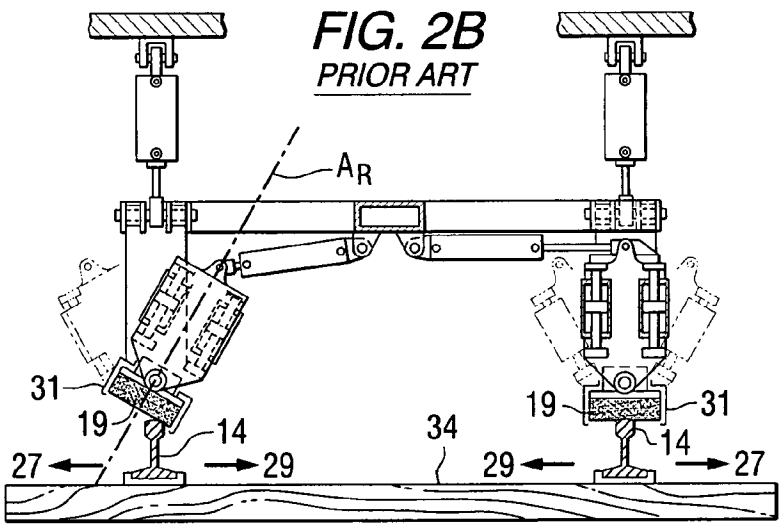
FIG. 2B PRIOR ART
FIG. 2B is a front view front of the horizontal rail grinding units shown in FIG. 2A.
Figure 2A:
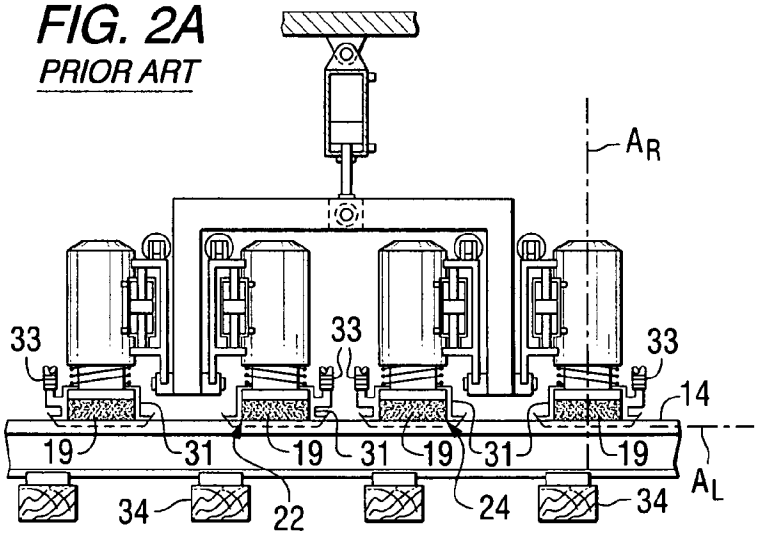
FIG. 2A PRIOR ART
FIG. 2A is a side view of multiple horizontal grinding units as used on the prior art rail grinding car shown in FIG. 1
Figure 8:
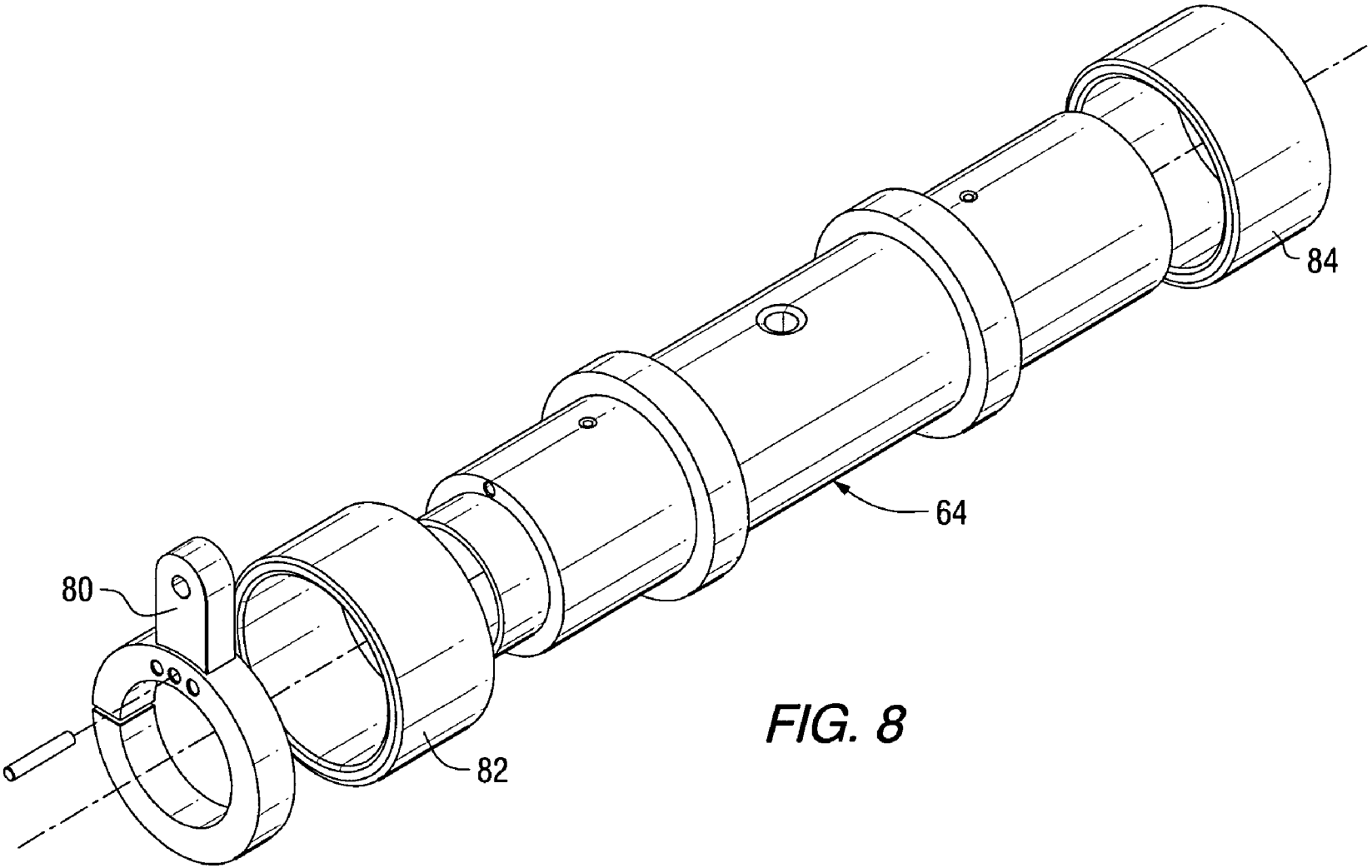
FIG. 8 is an enlarged perspective view of an embodiment of an eccentric member for use with the tilting assembly shown in FIG. 7.

The horizontal grinding units 19 are the specific subject of the present invention, and are deployed by the grinding car 10 as shown best in FIGS. 2A and 2B (which correspond to FIGS. 8 and 9 of the aforesaid patent). The grinding stone of the horizontal grinder unit 19 is conventionally an annular, cylindrical shaped stone, having a generally flat bottom surface, which defines the grinding surface that interfaces with the railhead 14. The grinding stone can typically have an outer diameter of about 6 inches and a wall thickness of about 1 or 1½ inches. At the center is a metal backing plate with a drive nut that threads onto the drive shaft of the motor. As shown, the grinding stone is conventionally held against the railhead 14 with the flat grinding surface generally horizontal to the surface of the railhead 14 which is being grinded. With respect to the railhead 14, the grinding stone can be visualized as having a forward edge 22 and a rearward edge 24, wherein the forward 22 and rearward 22 edges both lie along the longitudinal axis $A_L$ of the rail 14. The forward edge 22 is the considered the "leading" edge with respect to the movement of the rail grinding car 10 along the rails 14, and the opposite rearward edge is the "trailing" edge. In this position, both the leading 22 and trailing 24 edges of the grinding stone are held against the railhead 14, and both edges 22, 24 generate a separate stream of sparks (and swarf). The two spark streams will be ejected at nominally right angles to the railhead 14, i.e., generally tangential to each of the leading 22 and trailing 24 edges of the grinding stone. Since both edges 22, 24 contact the railhead 14, one spark stream will be generated in a direction toward the outside of the railhead 14, i.e., the field side 27, and another spark stream will be generated toward the inside of the railhead 14, i.e., the gauge side 29. The grinding stone is rotated clockwise (viewed from above), for which the spark stream generated by the leading edge 22 will be directed toward the field side 27 and the spark stream generated by the trailing edge 24 will be generated toward the gauge side 29. Of course, this would be reversed if the grinding stone were rotated in the opposite direction. Whether the grinding stone is rotated clockwise or counter-clockwise is to be considered with respect to the invention because it affects the selection of the leading 22 or trailing 24 edge to be used in the grinding operation to direct the spark stream away from nearby combustible materials, as will be explained in more detail hereinafter.

The grinding units 19 shown in FIGS. 2A and 2B include conventional spark shields, i.e. shrouds 31, which are intended to control sparks and swarf, but the shrouds 31 can be less effective than desired. In particular, the spark stream tends to escape below the lowest edge of the shroud 31. This can result because the lowest edge of the shroud 31 can extend only to slightly short of the bottom surface of the grinding stone. The shroud 31 cannot extend any lower, and not even equally to, the bottom surface of the grinding stone. Otherwise, the lower edge of the shroud 31 would interfere with the railhead 14. This can be why the grinding units 19 are also provided with a source of negative pressure indicated at 33, to try and draw the spark stream and swarf upwards into the shroud 31. However, this system can be less effective than can be desired.

According to the invention, a method for directing a spark stream generated by contact between a rotating grinding stone and the railhead 14 upwards and away from nearby combustible material can basically involve tilting the grinding stone at an angle to the railhead 14 such that only one of the leading edge 22 or trailing edge 24 of the grinding stone contacts the railhead 14 surface. The angle of the tilting is that provided in a plane defined by a longitudinal axis $A_L$ of the railhead 14 and an axis of rotation $A_R$ of the grinding stone. Another way to describe the orientation of the tilt angle is that the tilting results in only one of the leading 22 and trailing 24 edges (both edges 22, 24 lying along an axis parallel to the longitudinal axis $A_L$ of the railhead 14) contacting the railhead 14.

The tilting of the grinding stone is done such that the one of the leading 22 and trailing 24 edges which is selected to contact the railhead 14 is the edge which results in the spark stream being directed away from the nearby combustible material, and also preferably in an upward direction towards existing spark shields. The grinding stone need be tilted only a relatively small amount, for example to create an angle of from about 0.31 to about 0.81 degrees from horizontal, and more preferably, about 0.56 degrees. The direction of the tilting of the grinding stone, i.e., the selection of the edge to grind with, can be a function of the direction of rotation of the grinding stone, the surface grinding angle at which the grinding stone is held against the railhead 14 (not the tilt angle), and whether the field 27 or gauge side 29 of the railhead 14 is being ground.

Conventionally, the grinding stones are set at different angles to grind the flange of the railhead 14, and typically the gauge side 29, not only at a certain angle, but also to grind various facets onto the surface of the railhead in order to create a smooth transition between the various angles that are being grinded. The idea is not to have any sharp edges on the rail flange of the railhead 14 when the grinding process is completed.

Figure 3:
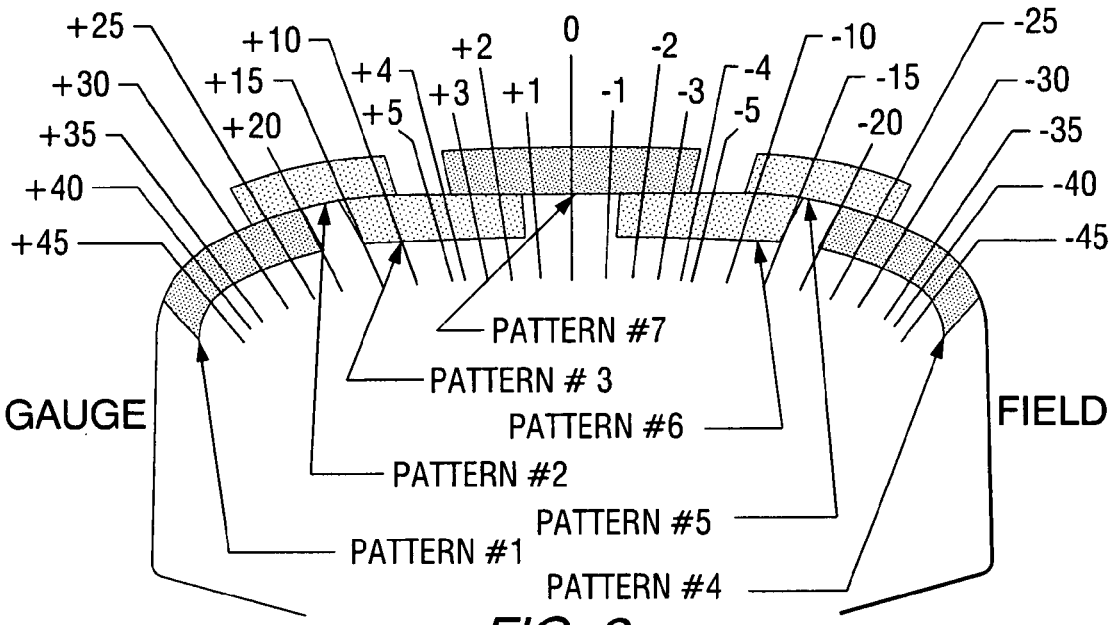
FIG. 3 is a diagram illustrating various conventional rail grinding patterns and angles.
Figure 4:
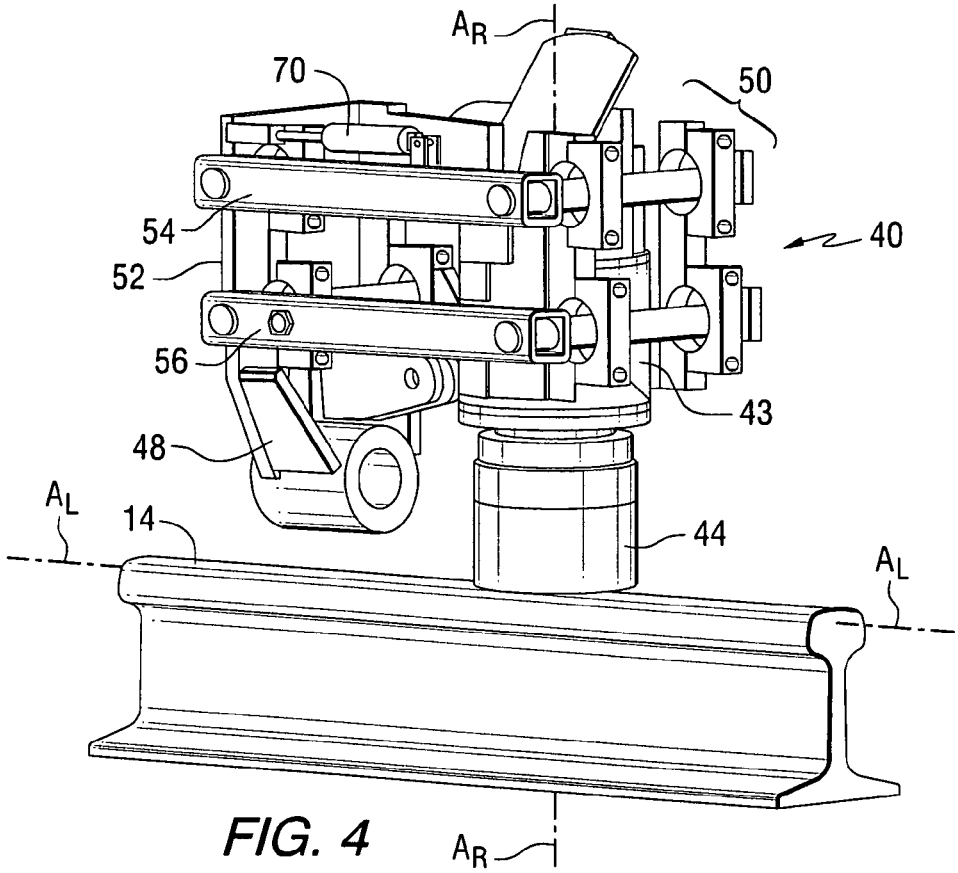
FIG. 4 is a perspective view of an embodiment of a horizontal rail grinder according to the invention.
Figure 5A:
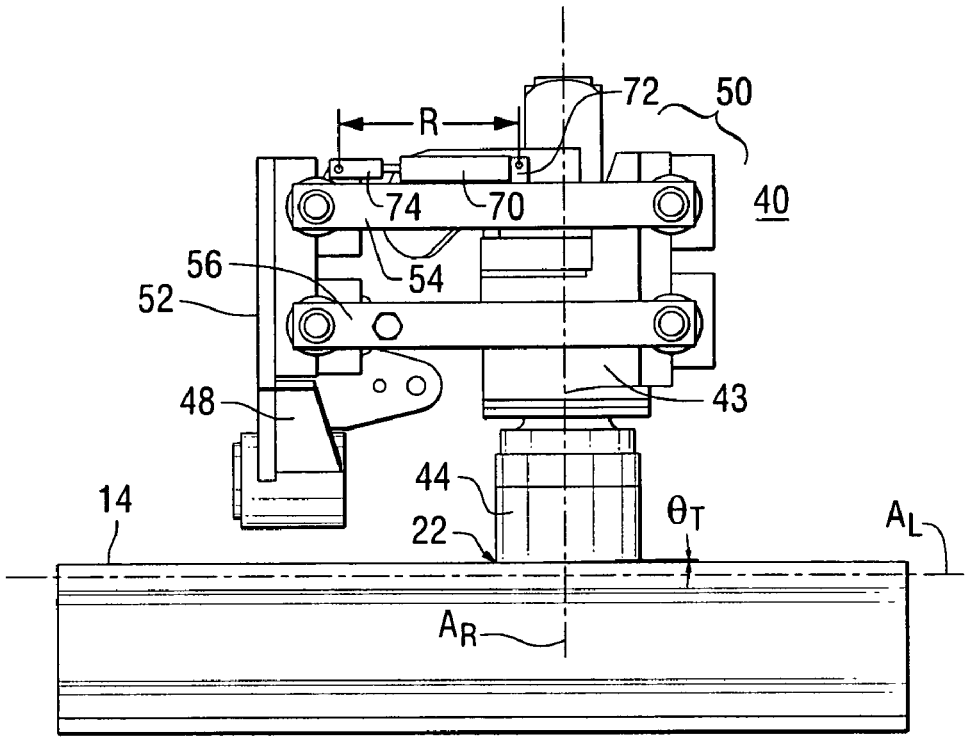
FIG. 5A is a side view of an embodiment of the horizontal rail grinding unit, shown tilted such that a leading edge of the grinding stone contacts the railhead.
Figure 5B:
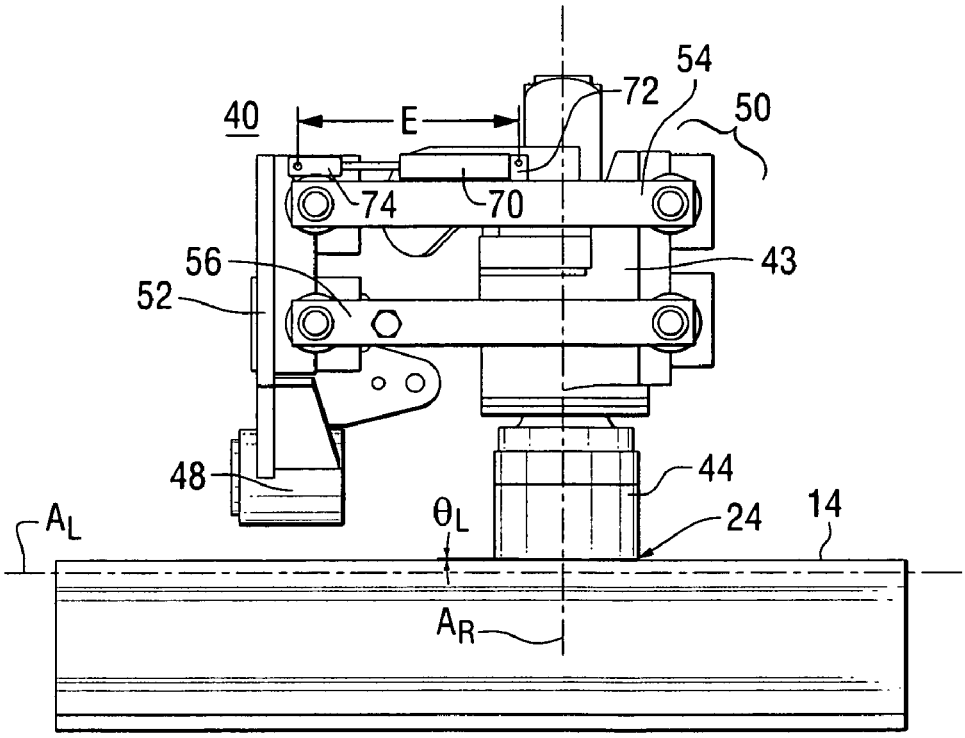
FIG. 5B is a side view similar to as shown in FIG. 5A, except wherein the grinding unit is tilted such that a trailing edge of the grinding stone contacts the railhead.
Figure 6C:
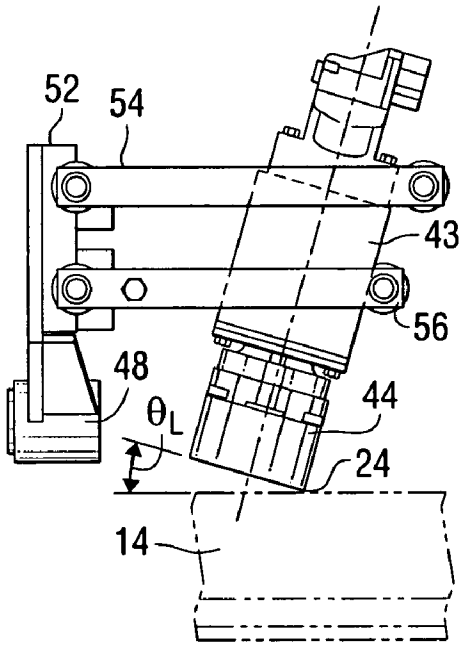
FIGS. 6A through 6C illustrate the tilting of the horizontal rail grinding unit according to the invention wherein the tilt angle is exaggerated for purposes of illustration.
Figure 6B:
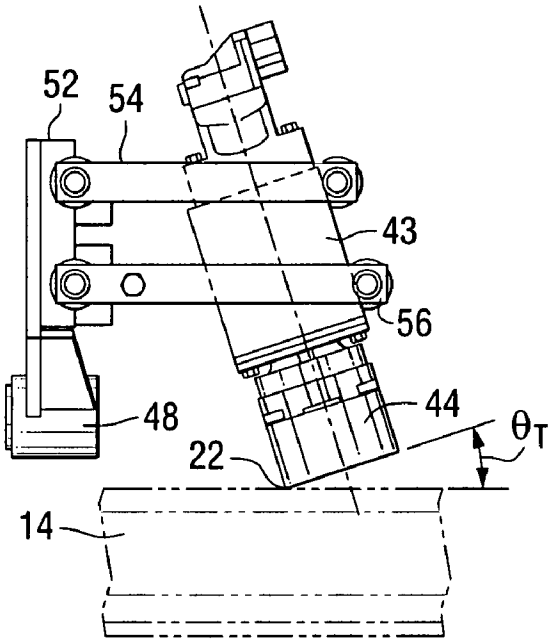
Figure 6A:
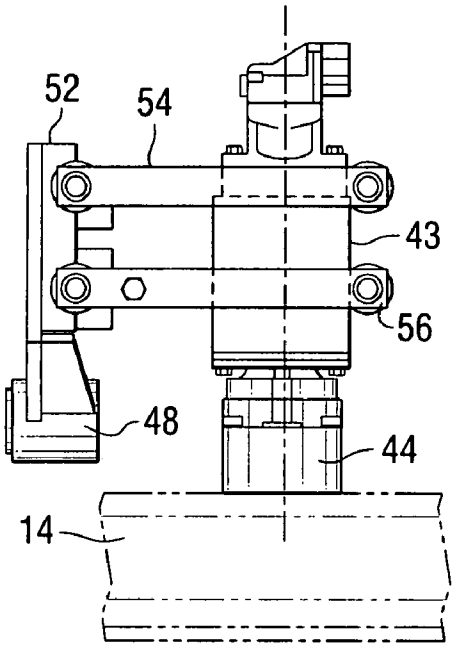

FIG. 3 illustrates the different railhead surfaces, or "grinding patterns," which are subjected to grinding by the rail grinding car 10 to smooth and reform the railhead 14. Standard nomenclature for grinding stone-to-railhead angle is negative toward the field and positive toward the gauge, with 0 defined as top of the rail, i.e., horizontal.

An unfortunate consequence of the rail grinding procedure is that when the grinding stone is grinding any angular surface of the railhead 14, i.e., any surface other than horizontal, such as the top surface of the railhead 14, sparks will be ejected against either the interior surfaces of the railhead ties 34 (on gauge side 29), or toward the lower limits of the shrouds 31 (on field side 27). This increases the likelihood igniting the railroad ties 34 on the gauge side 29, and surrounding grass and shrubbery on the field side 27. The grinding patterns define the angles at which the grinding stones are conventionally set with regard to the railhead 14. Individual grinding patterns, numbered "1" through "7" in the illustration, also include various degrees of angularity within each of the numbered "patterns." These patterns, and angles, are not in the same plane in which the tilt angle is provided. Rather these grinding patterns determine the positioning of the individual grinding units 19 at certain angles to grind a specific portion of the surface of the railhead 14.

Referring now to FIGS. 4 through 6C, an embodiment of an apparatus, such as a grinding unit 40, for directing a spark stream generated by contact between a rotating grinding stone 44 and a railhead 14 away from nearby combustible material can basically involve tilting the grinding stone 44 at an angle to the railhead 14 such that only one of a leading edge 22 or a trailing edge 24 of the grinding stone 44 contacts the surface of the railhead 14. As shown, the grinding unit 40 for grinding a railhead 14 can basically comprise a grinding unit 42 having a rotatable grinding stone 44 driven by a motor 43, a support member 48 adapted to hold the grinding unit 40 in a position with the grinding stone 44 against the railhead 14 during a grinding operation, a tilting assembly 50 associated with the support member 48 and the grinding unit 40, the tilting assembly 50 controllable to tilt the grinding unit 40 in a plane defined by an axis of rotation AR of the grinding stone 44 and a longitudinal axis $A_L$ of the railhead 14, wherein the grinding stone 44 is held at an angle against the railhead 14 during the grinding operation such that only one of the leading 22 and trailing 24 edges contacts the railhead 14 during the grinding operation, and wherein the one of the leading 22 and trailing 24 edges is selected such that a spark stream generated by the grinding operation is directed away from nearby combustible material, and also preferably upwards toward existing spark shields (not shown). The support member 48 can be associated with conventional positioning equipment on a rail grinding vehicle to provide the conventional angular displacement of the grinding units 40, i.e., positioning the grinding stones 44 at between 45 degrees towards the gauge 29 and 45 degrees towards the field 27, according to conventional grinding patterns.

Figure 7:
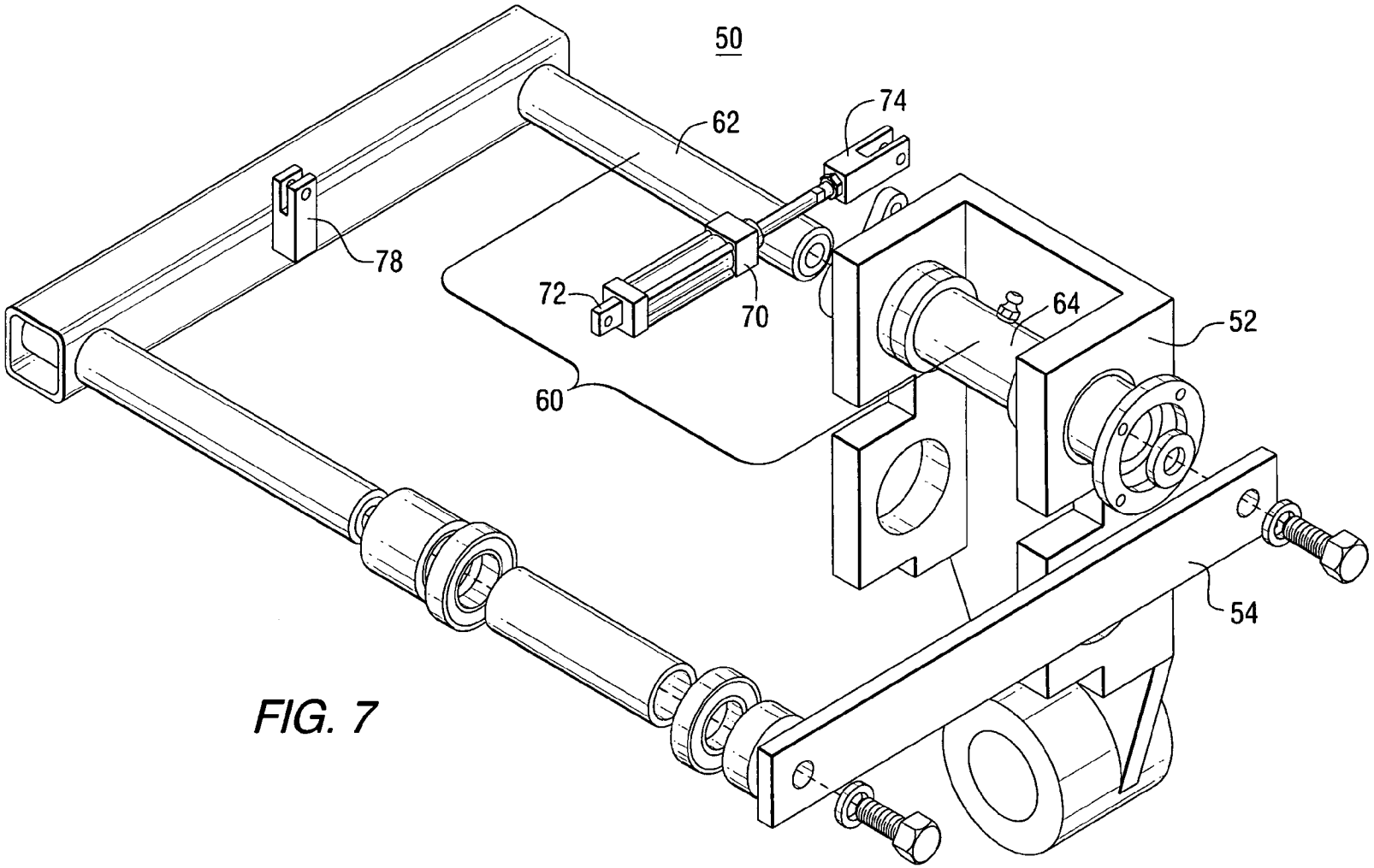
FIG. 7 is an exploded perspective view of an embodiment of a tilting assembly associated the horizontal rail grinding unit.

Referring to FIG. 7, in a preferred embodiment of the invention, the tilting assembly 50 can comprise a tilt bracket 52 connectable to the grinding unit 40 via upper 54 and lower 56 pairs of parallel arms, in which the upper pair 54 of parallel arms can be connected between an upper portion of the tilt bracket 52 and an upper part of the grinding unit 40, and the lower pair 56 of parallel arms can be connected between a lower portion of the tilt bracket 52 and a lower part of the grinding unit 40, which is adjacent the grinding stone 44. The upper pair 52 of parallel arms can be connected to the tilt bracket 52 via an eccentric assembly 60 wherein rotation of the eccentric assembly 60 shortens or lengthens the upper pair 54 of parallel arms relative to the lower pair 56 of parallel arms such that the grinding unit 40, and thus the grinding stone 44, is tilted relative to the railhead 14. The eccentric assembly 60 can comprise a shaft 62 connected between the upper pair 54 of parallel arms, a hollow tubular member 64 disposed over the shaft 62 for rotation relative thereto, wherein the upper portion of the tilt bracket 52 can be carried by the hollow tubular member 64, and the hollow tubular member 64 has an inner axis coaxial with the axis of the shaft 62 and an outer axis eccentric to the inner axis, whereby rotation of the hollow tubular member 64 relative to the shaft 62 shortens or lengthens the upper pair 54 of parallel arms relative to the lower pair 56 of parallel arms.

An actuator 70 can be connected to the hollow tubular member 64 for rotating the hollow tubular member 64 relative to the shaft 62 to tilt the grinding stone 44 relative to the railhead 14. The actuator 70 can be a variable length member having a first end 72 fixed with respect to a movable second end 74. The movable end 74 is connected to a lever 80 connected to, or extending from, the hollow tubular member 64 such that movement of the second end 74 of the variable length member 70 rotates the hollow tubular member 64. Rotation of the hollow tubular member 64 relative to the shaft 62 shortens or lengthens (depending on the direction of the rotation) the upper pair 54 of parallel arms relative to the lower pair 56 of parallel arms, causing the grinding stone 44 to tilt relative to the railhead 14. The first end 72 can be fixed to a bracket 78 which can be attached to, for example, one of the upper pair 54 of parallel arms. The actuator can be a hydraulic cylinder, which can be electrically controlled, for example, by a remote operator or control device. Alternatively, it will be recognized by those of skill in the art that other types of devices for rotating the hollow tubular member 64 could be devised for satisfactorily carrying out the function of the hydraulic cylinder.

In accordance with the preceding description, each grinding unit 40 can be mounted to a tilt bracket 52 using two pair of parallel arms 54, 56. The pairs of parallel arms 54, 56 can maintain the grinding units 40 orientation, i.e., in the proper angular position according to the desired grinding pattern and angle, when the vertical position is adjusted in a conventional manner. The two pair of parallel arms 54, 56, in conjunction with the grinding unit 40 and the tilt bracket 52, form parallelograms. The ends of each of the two pair of parallel arms 54, 56 can be rotatably connected to shafts which serve as axes of rotation for the parallelogram. One of the shafts, i.e., the shaft 62 which is associated with the upper pair 54 of parallel arms, is attached at the ends of the upper parallel arms 54 associated with the tilt bracket 52, can be mounted within the eccentric member 64. The opposite ends of the two pairs 54, 56 of parallel arms are connected, rotatably, to the grinding unit 40, or to a housing associated with the grinding unit 40.

Referring now to FIGS. 8 and 9A–9C, the eccentric member 64 can be a hollow cylindrical tube having the inner axis $A_I$ offset from, i.e., eccentric to, an outer axes AO thereof. The inner axis $A_I$ is concentric with the axis of the shaft 62 which is rotatably disposed therein. A lever 80 can be attached to the eccentric member 64, or project from an outer surface thereof, such that movement of the lever 80 will rotate the eccentric member 64. The lever 80 can be attached to the movable end 74 of the actuator 70 for rotating the eccentric member 64.

The eccentric member 64 can be mounted within bearings 82, 84 associated with the tilt bracket 52, such that rotation of the eccentric member 64 changes the position of the inner axis $A_I$ of the eccentric member 64, and thus the axis of the shaft 62, relative to the fixed position of the outer axis $A_O$. This shift of the axis of the shaft 62 changes the shape of the parallelogram, by shortening or lengthening the upper pair 54 of parallel arms with respect to the lower pair 56 of parallel arms which have a fixed length. This results in a shift in orientation, i.e., tilting, of the grinding unit 40 and a corresponding change in the contact angle between the grinding stone 44 and the railhead 14.

The tilting assembly 50 can be designed in such a manner that when the actuator 70 retracts the movable end 74 (shortens), the grinding unit 40 is angled away from the eccentric, and the edge of the grinding stone 74 furthest from the eccentric is positioned to make contact with the railhead 14. Conversely, when the actuator 70 extends the movable end 74 (lengthens), the grinding unit 40 pivots toward the eccentric, causing the edge of the grinding stone 44 closest to the eccentric to be positioned to make contact with the railhead 14.

Figure 9A:
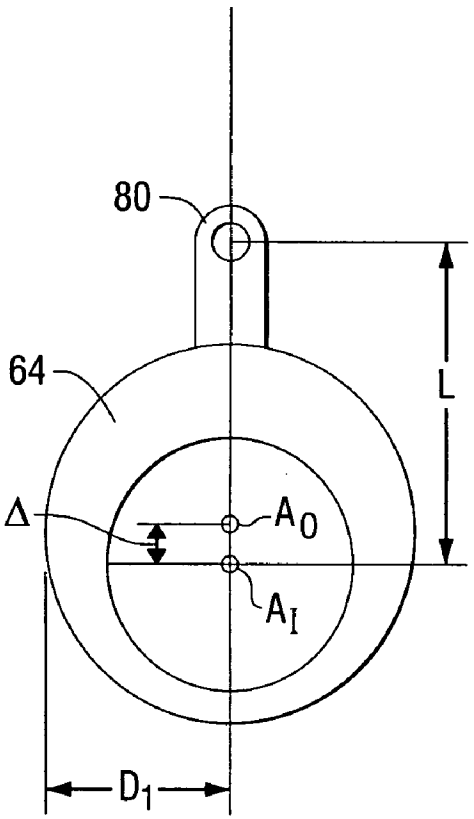
FIGS. 9A through 9C are cross section views of the eccentric member shown in FIG. 8.
Figure 9B:
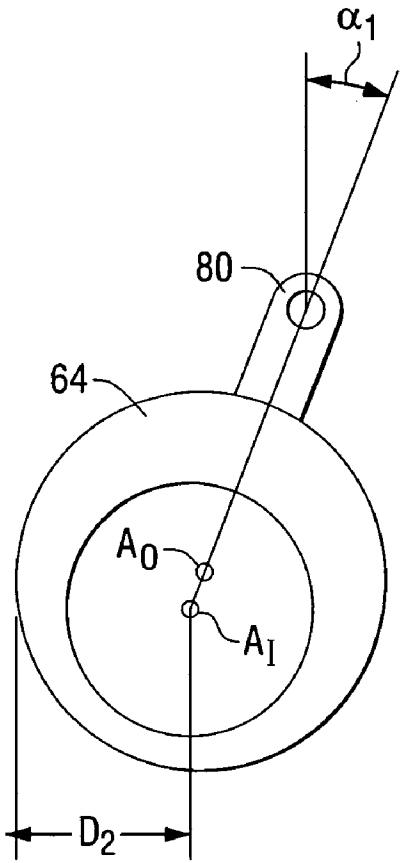
Figure 9C:
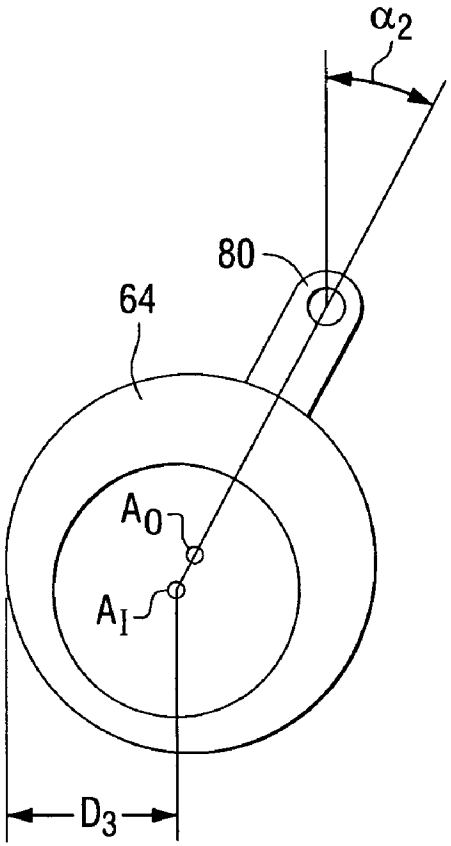

As shown best in FIGS. 9A through 9C, the length from the inner axis $A_I$ of the eccentric member to the attachment point of the lever 80 to actuator 70, can, in a preferred embodiment, be about 2.08 inches and the distance between the inner axis $A_I$ and outer axis $A_O$ can be about 0.10 inches. In FIG. 9B, the eccentric is shown rotated at an angle $\alpha_1$, which can be about 21 degrees in a preferred embodiment, and can equate to a ¾ inch stroke by the actuator 70 and an overall displacement of approximately 0.075 inch. In FIG. 9A, the distance $D_1$ from the inner axis $A_I$ of the eccentric member 64 to the outer edge thereof is approximately 1.2150 inches. In FIG. 9B, at the ¾ inch stroke, the distance $D_2$ can now be 1.1421 inches. FIG. 9C illustrates a one inch stroke by the actuator 70, and a corresponding angle $\alpha_2$ of 28 degrees. Also, the distance between the inner axis $A_I$ and the outer edge of the eccentric member 64 has been reduced to 1.1202 inches. The one inch stroke equates to approximately 0.095 inch displacement. The one inch stroke can, in a preferred embodiment, be the preferred stroke of the actuator 70 in order to tilt the grinding unit 40 and create an angle ($\theta_T$ or $\theta_L$), shown in FIGS. 5A and 5B, between the bottom surface of the grinding stone 44 and the surface of the railhead 14 which is being grinded. Whether the leading edge 22, which corresponds to angle $\theta_L$, or the trailing edge 24, which corresponds to angle $\theta_T$, is selected, the angular displacement $\theta_T$ or $\theta_L$ can be, in a preferred embodiment corresponding to the presently preferred dimensions explained above, from about 0.21 degrees to about 0.85 degrees. More preferably, angle can about 0.56 degrees. It should be understood that the specific dimensions and angular data described above are illustrative of a preferred embodiment of the invention, and that other dimensions and angular displacements could also be employed in keeping with the implementation of the invention.

As explained above, the choice of which way to tilt the grinding unit 40, i.e., which edge of the grinding stone 44 to grind with, is based upon which direction it is desired to direct the spark stream. This, in turn, can be a function of the direction of rotation of the grinding stone 44 (typically clockwise), the grinding pattern (including the specific grinding angle) and whether the grinding is being done on the gauge 29 or field 27 side of the railhead 14. On the gauge side 29, the grinding unit 40 is tilted so that the only contact is with the edge of the grinding stone that directs sparks outward. On the field side 27, the grinding unit 40 is tilted so that the only contact is with the edge of the grinding stone 44 that directs sparks inward and upward.

According to the invention, a tilting assembly 50 can be provided associated with each grinding unit 40, to position each grinding unit 40 at the desired tilt angle against the railhead 14. Additionally, a computer controller (not shown) can be utilized, such as by appropriate programming, to automatically determine both the magnitude of and direction of the tilt angle.

Assuming the direction of rotation of the grinding stone 40 is clockwise, as viewed from above, if the grinding pattern is 1, 2, or 3, and the angle is greater than (+) 15 degrees, then the left, or leading, edge 22 will be selected to contact the railhead. If the grinding pattern is 4, 5, 6, or 3 and the angle is at (+) 15 degrees or less, then the trailing, or right, edge 24 will be selected to contact the railhead 14. If grinding pattern is 7, the contact angle is, by definition, zero (0) degrees, then the left, or leading, edge 22, will be selected to contact the railhead. If the angle is (+) 15 degrees, or more, then the right, or trailing, edge 24 will be selected.

Accordingly, the change-over from the leading 22 to trailing 24 edge can, in a preferred embodiment, be instituted at about (+) 15 degrees. Thus, for all grinding patterns which require angles between (+) 45 and (+) 15 degrees, the grinding stone 40 will be tilted to the right to employ the right, or trailing, edge 24. This will direct the spark stream, and swarf, toward the field side 27 of the railhead 14. For all grinding angles with values lower than (+) 15 degrees, e.g., from about (+) 14 degrees to about (−) 45 degrees, the grinding stone 40 is tilted to the left to employ the left, or leading, edge 22. This directs the spark stream, and swarf, toward the gauge side 29 of the railhead 14. However, it is to be understood that the change-over point is operator selectable.

Before a section of rail is ground, an analysis is typically performed to determine the location and extent of grinding required to restore the railhead 14 to its original profile. A grinding pattern that will meet these criteria is selected from a menu of patterns (such as shown in FIG. 3) that can be programmed into the computer controller. The computer controller, thus programmed with these patterns, and range of associated angles, can cause the grinding units 40 to move into their appropriate positions in the conventional manner in accordance with the selected grinding pattern. Then, the computer controller can implement the tilt angle for each grinding unit 40, via the tilting assembly 50 associated with each grinding unit 40, depending upon the called for grinding pattern for that grinding unit 40. The grinding pattern can include both specific angular data, which also defines whether the grinding is on the gauge 29 or field 27 side of the railhead 14. Once the grinding pattern is set, the computer controller can automatically activate the tilting assembly 50 to direct the flow of sparks away from combustible materials, and preferably upwards toward existing spark shields.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A method for directing a spark stream generated by contact between a rotating grinding stone and a railhead away from nearby combustible material, said method comprising tilting said grinding stone at an angle such that only one of a leading edge and a trailing edge of said grinding stone contacts said railhead surface, said tilting provided in a plane defined by a longitudinal axis of said railhead and an axis of rotation of said grinding stone.

2. The method of claim 1 further comprising tilting said grinding stone such that said one of said leading and trailing edges which contacts said railhead results in said spark stream being directed upwardly and away from said nearby combustible material.

3. The method of claim 1 further comprising tilting said grinding stone as a function of a direction of rotation of said grinding stone and whether said grinding stone contacts said railhead on a gauge side or on a field side of said railhead.

4. The method of claim 3 further comprising:

a. said direction of rotation of said grinding stone is clockwise;

b. said leading edge selected to contact said railhead when said grinding stone is operated at a grinding angle of more than (+) 15 degrees as defined in accord with conventional rail grinding patterns;

c. said trailing edge selected to contact said railhead when said grinding stone is operated at a grinding angle (+) 15 degrees or less as defined in accord with conventional rail grinding patterns.

5. The method of claim 1 further comprising tilting said grinding stone at an angle of from about 0.31 to about 0.81 degrees from horizontal.

6. The method of claim 1 wherein said angle is about 0.56 degrees.

7. An apparatus for grinding a railhead comprising:

a. a grinding unit having a rotatable grinding stone, said grinding stone having a leading edge and a trailing edge;

b. a support member adapted to hold said grinding unit in a position with said grinding stone against said railhead during a grinding operation;

c. a tilting assembly associated with said support member and said grinding unit, said tilting assembly controllable to tilt said grinding unit in a plane defined by an axis of rotation of said grinding stone and a longitudinal axis of said railhead;

d. wherein said grinding stone is held at an angle against said railhead during said grinding operation such that only one of said leading and trailing edges contacts said railhead during said grinding operation; and e. wherein said one of said leading and trailing edges is selected such that a spark stream generated by said grinding operation is directed away from nearby combustible material.

8. The apparatus of claim 7 wherein said tilting assembly further comprises:

a. a tilt bracket connected to said grinding unit via upper and lower pairs of parallel arms;

b. said upper pair of parallel arms connected between an upper portion of said tilt bracket and an upper part of said grinding unit;

c. said lower pair of parallel arms connected between a lower portion of said tilt bracket and a lower part of said grinding unit adjacent said grinding stone; and d. said upper pair of parallel arms connected to said tilt bracket via an eccentric assembly wherein rotation of said eccentric assembly shortens or lengthens said upper pair of parallel arms relative to said lower pair of parallel arms such that said grinding unit, and thus said grinding stone, is tilted relative to said railhead.

9. The apparatus of claim 8 wherein said eccentric assembly further comprises:

a. a shaft connected between said upper pair of parallel arms;

b. a hollow tubular member disposed over said shaft for rotation relative thereto, said upper portion of said tilt bracket carried by said hollow tubular member, said hollow tubular member having an inner axis coaxial with said shaft and an outer axis eccentric to said inner axis such that rotation of said hollow tubular member relative to said shaft shortens or lengthens said upper pair of parallel arms relative to said lower pair of parallel arms; and c. an actuator connected to said hollow tubular member for rotating said hollow tubular member relative to said shaft to tilt said grinding stone relative to said railhead to direct said spark stream away from said nearby combustible materials.

10. The apparatus of claim 9 further comprising:

a. said actuator being a variable length member having a fixed end and a second end movable toward said fixed end;

b. said hollow tubular member having a lever extending therefrom, said lever connected to said second end of said variable length member; and c. wherein movement of said second end of said variable length member toward said first end thereof rotates said hollow tubular member relative to said shaft to shorten or lengthen said upper pair of parallel arms relative to said lower pair of parallel arms to tilt said grinding stone relative to said railhead.

11. The apparatus of claim 7 wherein said angle is from about 0.31 to about 0.81 from horizontal.

12. The apparatus of claim 11 wherein said angle is about 0.56 degrees.

* * * * *